United States Patent [19]

Sterman et al.

[11] Patent Number: 4,614,082

[45] **Date of Patent: * Sep. 30, 1986**

[54] COMBUSTION CHAMBER CONSTRUCTION

[75] Inventors: Albert P. Sterman; Thomas G. Wakeman; Jesse J. Williams, all of Cincinnati, Ohio

[73] Assignee: General Electric Company, Cincinnati, Ohio

[ * ] Notice: The portion of the term of this patent subsequent to Nov. 6, 2001 has been disclaimed.

[21] Appl. No.: 316,530

[22] Filed: Dec. 19, 1972

[51] Int. Cl.[4] ..... F02C 7/20

[52] U.S. Cl. ..... 60/39.32; 60/752

[58] Field of Search ..... 60/39.65, 39.66, 39.69, 60/39.32, 39.36, 752, 753, 754, 755, 756, 757, 758, 759, 760

[56] References Cited

U.S. PATENT DOCUMENTS

| | | | |
|---|---|---|---|
| 2,544,538 | 3/1951 | Mahnken et al. | 60/39.66 |
| 2,918,793 | 12/1959 | Jerie et al. | 60/755 |
| 2,919,549 | 1/1960 | Haworth et al. | 60/755 |
| 4,480,436 | 11/1984 | Maclin | 60/757 |

*Primary Examiner*—Stephen C. Bentley

*Attorney, Agent, or Firm*—Douglas S. Foote; Derek P. Lawrence

[57] ABSTRACT

A combustion chamber for use in gas turbine engines is provided with a liner formed of a high temperature material. The liner includes a plurality of panels of the material mounted by means of a slideable friction mounting arrangement upon a high strength structural frame. As a result of this mounting arrangement, the liner is substantially isolated from structural forces associated with the combustion chamber, while the frame is substantially isolated from thermal stresses associated with the liner. Means are provided for positioning and securing individual liner panels in the circumferential, axial, and radial directions with respect to the frame as well as circumferentially with respect to other liner panels. The individual liner panels may be easily removed for repair or replacement without disassembling the frame and associated components. For the purpose of cooling, a cooling fluid is passed into a plenum to cool the radially outward side of the panels by convection. Means are also provided for directing the same fluid from the plenum to the liner inner surfaces in a cooling film.

12 Claims, 8 Drawing Figures

COMBUSTION CHAMBER CONSTRUCTION

The invention herein described was made in the course of or under a contract, or a subcontract thereunder, with the United States Department of the Air Force.

Related to this application are co-pending and concurrently filed cases, Ser. No. 316,441 and Ser. No. 316,532 both filed Dec. 19, 1972 and assigned to the same assignee as the present application.

BACKGROUND OF THE INVENTION

This invention relates to gas turbine engines, and more particularly to combustion chambers for use therein.

Gas turbine engine efficiency is a function of various parameters, among them the temperature achievable within combustion chambers, as well as the amount of air which must be diverted to cool various elements of the engine. Contemporaneously, the structural integrity of an engine is improved if structural loads are carried by elements of the engine which elements are not also subjected to high temperatures and attendant thermal stresses.

In an attempt to raise achievable temperatures within combustion chambers, various materials and alloys have been used in the construction of the chambers. Two such materials which exhibit particularly beneficial thermal resistance are oxide dispersion strengthened metals such as thoria dispersed nickel and thoria dispersed nickel chromium alloy, which have melting temperatures of approximately 2500° to 2600° F., and which exhibit high strength characteristics up to temperatures of 2200° F. Thus, these materials would prove successful in the construction of combustion chambers. A major drawback of these and certain other high temperatures materials, however, is that they are difficult or impractical to weld. A co-pending application, Ser. No. 316,531, now U.S. Pat. No. 4,480,436 and assigned to the common assignee, discloses an invention making possible the use of these and other appropriate materials in the construction of combustion chambers.

The effective application of such high temperature operating materials as those discussed, in addition to enabling higher temperatures to be reached, will also allow a reduction in the amount of cooling fluid required to be directed to the combustion chamber during operation. This reduction enables the engine to operate with increased efficiency. The present invention also provides means for more effectively utilizing a reduced quantity of cooling air to cool both the inner and outer sides of the combustion chamber liner.

Structural failures in gas turbine engines in the past have sometimes resulted from the subjection of structural load bearing portions of the engine to thermal stresses associated with the high temperatures of combustion. The formation of a combustion chamber in a way that requires the chamber liner (which is directly exposed to the heat of combustion) to carry structural loads associated with the combustion chamber has sometimes resulted in such failures. Use of the configuration of the present invention overcomes these problems by isolating the liner of the combustion chamber from the structural loads associated with the frame encircling the chamber.

Another significant facet of the present invention is that it permits the easy and efficient removal of individual liner panels without the necessity for total disassembly of the structural frame and associated components. This, in turn, permits the substitution of new liner panels for those which may have become worn over extended use, or the repair of individual liner panels which retain a useful life. Such a capability proves a great cost saving with respect to prior art devices wherein combustion chambers have been formed of substantially unitized construction and wherein damage or wear to a single portion of the chamber has necessitated the replacement of large sections thereof.

SUMMARY OF THE INVENTION

It is therefore a primary object of the present invention to provide a combustion chamber for use in gas turbine engines which provides improved structural integrity by providing independent elements for subjection respectively to thermal and structural stresses associated with a combustion chamber.

It is another object of the present invention to provide a combustion chamber for use in gas turbine engines wherein an improved liner formed of a plurality of panels provides easy and effective repair and replacement capabilities.

It is a further object of the present invention to provide a combustion chamber for use in gas turbine engines having improved means for passing a quantity of cooling air over the chamber liner in a manner which accomplishes improved utilization thereof.

These objects, and others which will become apparent from the detailed description thereinafter, are accomplished by the present invention in one form thereof, by means of the use of a liner formed of a plurality of liner panels. The panels cooperate circumferentially with one another in a tongue and groove relationship facilitated by a slideable friction engagement between one another. Likewise, means are provided for providing a slideable frictional retaining means for securing the panels in the axial direction with respect to a circumscribing structural frame. Means are provided for restraining circumferential rows of panels from motion in the circumferential direction relative to the frame. Furthermore, means are provided for positioning and retaining each of the panels at a predetermined radial distance from the frame and for restraining the panels against motion in the radial direction. For the purpose of cooling the panels, a plenum is defined between each panel and an associated portion of the structural frame, into which plenum is directed a quantity of cooling fluid. Each panel likewise bears an exit aperture through which the cooling fluid is exhausted from the plenum and directed over the heated side of preselected panels for the purpose of providing film cooling thereto. For the purpose of easy removal and replacement, the means for mounting the individual panel provides for reversibility of fabrication.

The present invention is more particularly described in conjunction with the following drawings, wherein.

DESCRIPTION OF A PREFERRED EMBODIMENT

Figure 1:
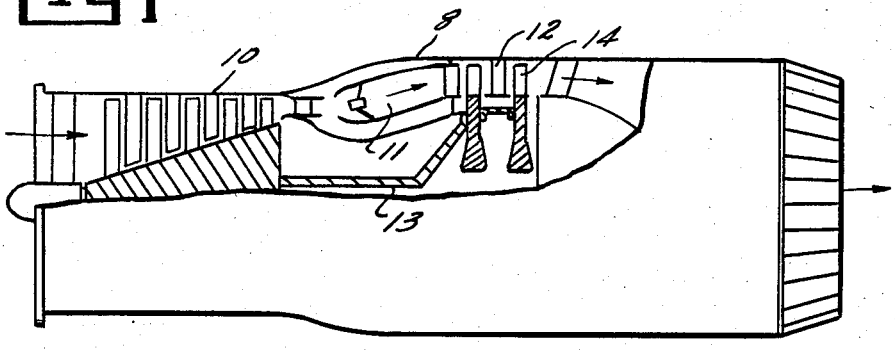
FIG. 1 is a simplified cross-sectional view of a gas turbine engine.

The gas turbine engine depicted in FIG. 1 includes the basic elements of typical turbomachinery of this variety. A substantially cylindrical housing 8 surrounds a compressor 10, combustion chamber 11, and a turbine 12, all disposed about a rotatable shaft 13. As is well known in the art, atmospheric air enters the engine from the left to be pressurized, heated and expelled to the right to provide usable thrust. More particularly, air enters from the left and is operated upon the compressor 10 to be pressurized and directed, in part, to combustion chamber 11. Heat energy is added to the air within the combustion chamber by the burning of appropriate fuel supplied thereto. Working fluid, which is the combination of air and burning fuel, exits at the right end of the combustion chamber 11 and engages a plurality of turbine blades 14 carried by a number of adjacent discs making up turbine 12. The engagement of the turbine blades by the working fluid serves to drive the turbine in rotation, which rotation is imparted to shaft 13. The rotation of shaft 13 initiates and powers the operation of compressor 10 at the forward end of the machine.

The operating temperature within combustion chambers presently reaches 2000° F. In the future, this figure will increase. For this reason, the combustion chamber must be capable of withstanding extremely high temperatures while maintaining its structural integrity. Furthermore, the quantity of cooling air provided for cooling the combustion chamber must be limited in order to achieve high engine efficiency. (Cooling may be accomplished by means of any of a number of cooling fluids; however, air is most prevalent and will be used for the purposes of discussion throughout. The present invention will be easily adaptable to the use of other varieties of cooling fluid.)

Figure 2:
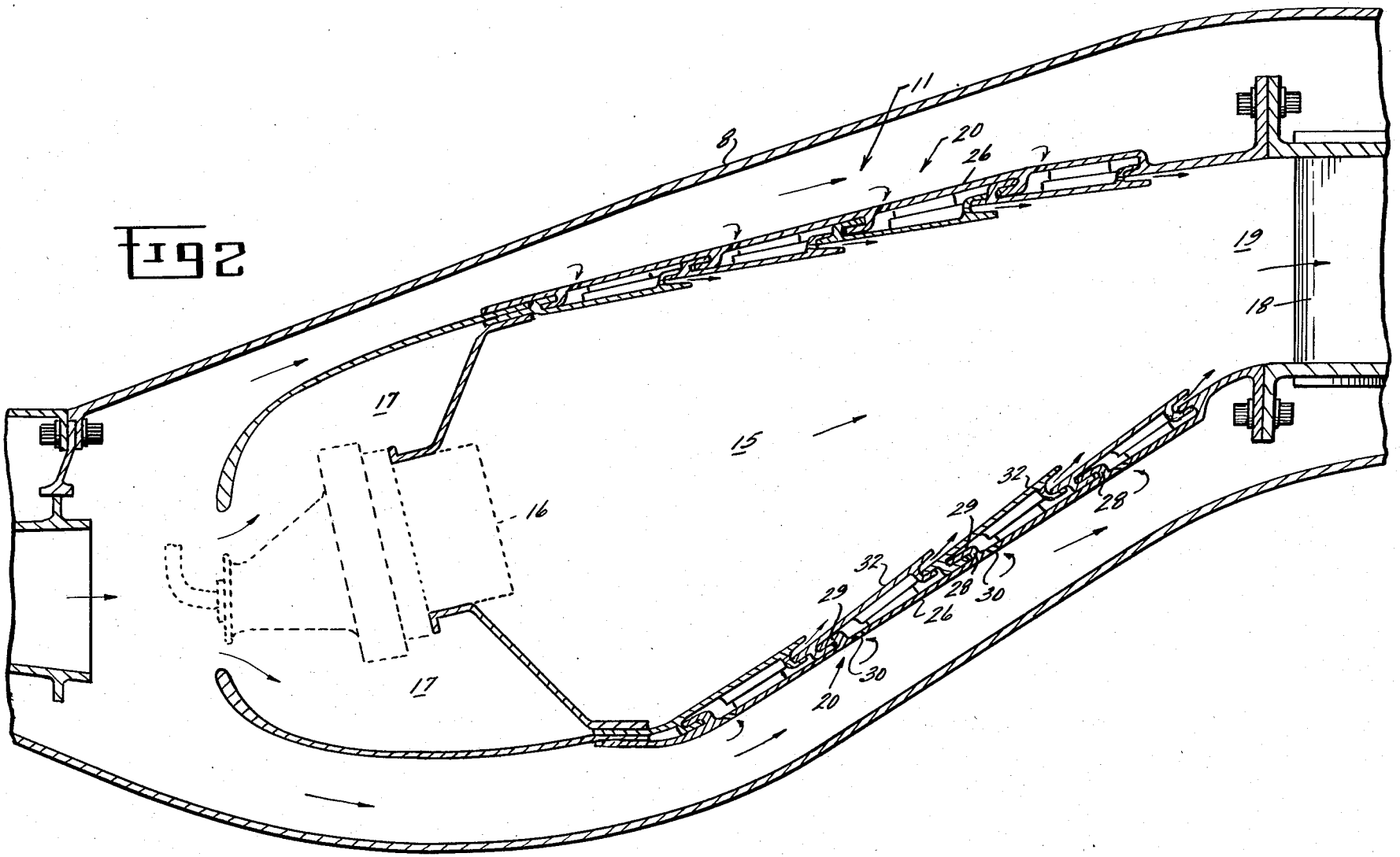
FIG. 2 is a cross-sectional view of a combustion chamber according to the present invention.

Referring to FIG. 2, the combustion chamber 11 defines a combustion zone 15 and includes a fuel nozzle 16 disposed within an upstream air/fuel inlet 17. A turbine nozzle stage 18 is disposed within a downstream outlet 19 for expelling the products of combustion. The combustion chamber also includes a high strength structural frame 20. The frame includes a backing piece 26 which carries a plurality of radially extending shoulders 28. Each shoulder 28 is provided with an axially extending flange 29. In addition, the backing piece 26 includes a plurality of apertures 30 disposed in circumferential rows between adjacent flanges 29 for the purpose of directing cooling air over the radially outward surfaces of the combustion chamber.

For the purpose of withstanding the extreme temperatures of combustion required for efficient gas turbine engine operation, a heat resistant liner is provided by the present invention. According to the present invention, the liner takes the form of a plurality of panels 32 (depicted in FIGS. 2 through 5), mounted upon structural frame 20 and substantially circumscribing the combustion zone 15 of the combustion chamber 11 for the purpose of forming a barrier against the heat of combustion therein. Panels 32 are formed, of a heat resistant metallic alloy or other composition. A particular problem with respect to many of such mateials in the past which has substantially prevented their use in combustion chambers of the prior art is the inability of these materials to maintain their desirable properties after being welded. Fabrication of such materials into viable combustion chambers is accomplished by means of the present invention, in addition to the provision for easy maintainability and replaceability thereof.

The present invention provides an improved mounting technique whereby the individual liner panels 32 of heat resistant material can be attached to the structural frame 20 without welding. The cooperation between individual liner panels and the frame, as well as between adjacent panels, is accomplished by means of frictionally slideable mounting techniques such that dimensional distortion of either the liner or the frame is not transmitted to the other. Thus, the liner is effectively isolated from structural loads associated with the frame; and the frame is effectively isolated from thermal stresses associated with the liner.

Figure 3:
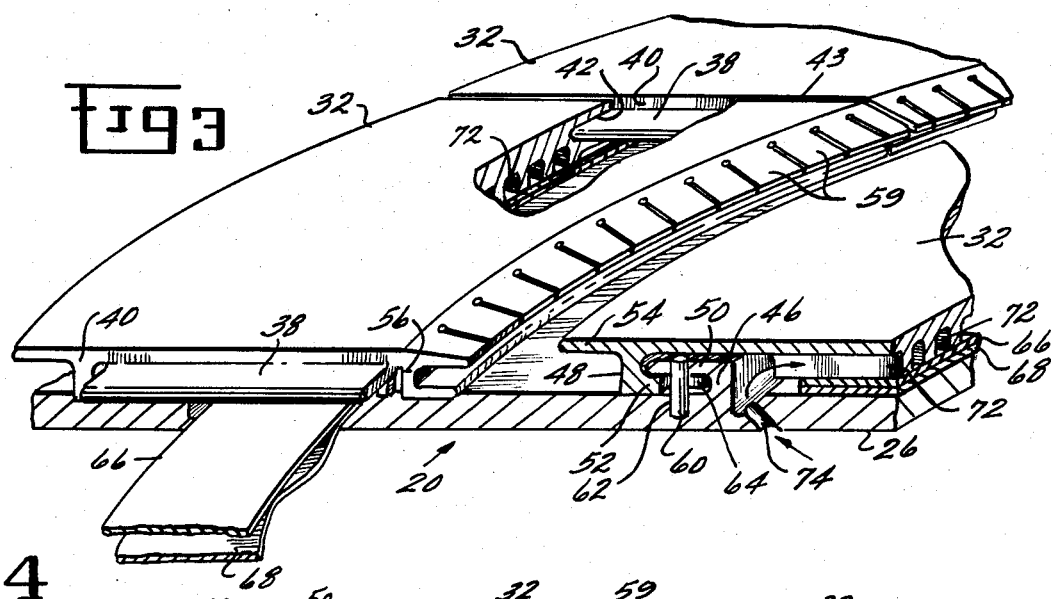
FIG. 3 is an enlarged view of a portion of the combustion chamber of FIG. 2, partially in section, illustrating one embodiment of the present invention during the process of fabrication.
Figure 4:
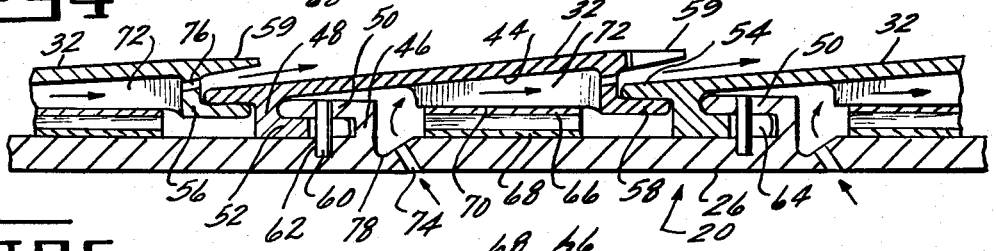
FIG. 4 is a cross-sectional enlarged view of the combustion chamber of FIG. 3 in completed form.
Figure 5:
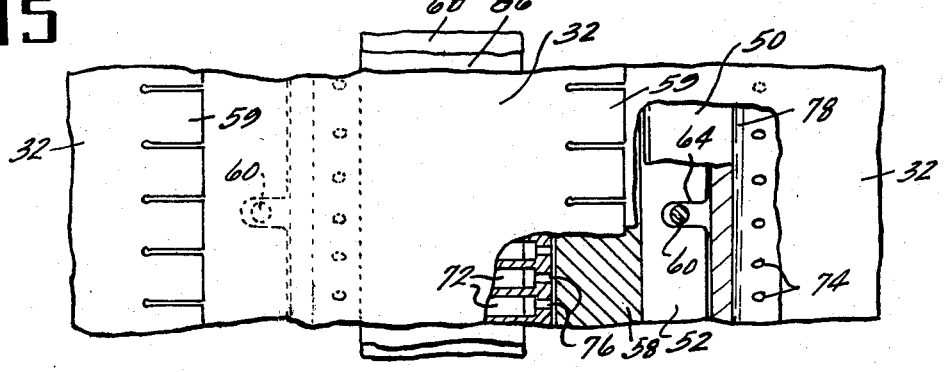
FIG. 5 is a plan view of a portion of the combustion chamber of FIG. 2, partially cut away.

To further illustrate this concept, individual liner panels 32 are depicted in FIGS. 3 through 5. Each panel has a circumferentially extending projection 38 cooperating with one of its lateral edges 40, and a recess or slot 42 defined upon its opposite edge 43. The projection and slot are dimensioned so as to provide a slideable friction tongue and groove cooperation when brought into proximity with opposed edges of panels disposed laterally adjacent each panel 32. For the purpose of weight reduction and cooling, each panel has a depression 44 in its back side. The lateral tongue and groove cooperation between opposed projections 38 and slots 42 combine to provide a circumferential mounting means for positioning the panels laterally with respect to one another.

In addition, the present invention provides axial mounting means for positioning the panels axially with respect to the frame. Referring to FIGS. 3 and 4, the axial mounting means includes a first shoulder 46 extending radially from the backing piece 26 of frame 20. A second shoulder 48 cooperates with the leading edge portion of each panel 32, extends radially therefrom; and engages shoulder 46. For the purpose of interlocking the two shoulders and securing the panels to the frame, shoulder 46 includes a flange 50 which extends axially therefrom, and the shoulder 48 includes a flange 52 which extends axially therefrom and engages, underlies and interlocks with the first flange.

In the foregoing fashion, the leading edge of each liner panel 32 is secured with respect to frame 20. In addition, the axial mounting means includes means for securing the trailing edges of each of the panels with respect to one another and the frame. To this end, each panel 32 carries an axially projecting flange 54 at its leading edge, and a radially extending depending shoulder 56 at its trailing edge along with a flange 58 cooperating with and extending axially from the shoulder 56. The flanges 58 and 54 are positioned and dimensioned so as to provide a frictionally slideable engagement when brought into cooperation with the converse elements of axially adjacent panels. Consequently, the trailing edge of each panel 32 is restrained from axial or radial movement in the fabricated configuration of the liner by means of the engagement between flanges 54 and 56.

According to a major object of the present invention, the circumferential mounting means, as well as the axial mounting means, hereinbefore described are, as stated, dimensioned to provide frictionally slideable engagements. This characteristic enables minor changes in relative position between the panels and the frame or between adjacent panels without transmitting attendant stresses to the mating parts. For example, thermal stresses imposed upon panels 32 during combustion within combustion zone 15 may cause expansion of the panel 32 in both the axial and circumferential directions. Were the laterally adjacent panels 32 rigidly connected with one another, such expansion would create substantial hoop stress between the panels tending to force them out of the correct positions. Such hoop stress is characteristic of unitized combustion chamber liners of the prior art. This undesirable characteristic is overcome by the present invention because the frictionally slideable cooperation between the tongue and groove elements of projections 38 and slots 42 permit the circumferential expansion of adjacent panels 32 to occur without transmitting the expansion in the form of hoop stress to adjacent panels. In other words, projections 38 slide within slots 42 in the circumferential direction and achieve a new equilibrium position, with the panels 32 retaining the same positions, but with their edges slightly closer together.

Similarly, the thermal expansion of panels 32 in the axial direction may be controlled without transmission of the stress associated therewith to other elements. More particularly, due to the sliding frictional fit between each pair of flanges, at the leading and trailing edges respectively of axially adjacent panels, expansion of the panels may be absorbed in a manner similar to that described above. Dimensioning of the flanges and disposition relative to the associated panels 32 according to the present invention permits axial sliding adjustment between the flanges without the necessity for the axial ends of the flanges to engage and transmit stress to any elements. Alternatively, the same effect may be obtained even though the cooperation between flanges 50 and 52 rigidly define the position of flange 52 relative to backing piece 26 of frame 20. In this situation, axial thermal expansion of the panels 32 would tend to extend each panel in one axial direction only, that is, in the downstream direction. Nevertheless, axial expansion would not impose mechanical stress upon either the frame or adjacent panels since the flanges 54 and 58 may be dimensioned to absorb all of such expansion through relative sliding.

The foregoing exemplifies the manner in which the frame 20 and the liner comprising panels 32 may be maintained free from mechanical stresses associated with thermal expansion of the individual panels 32. Conversely, the mounting means disclosed herein enables the panels 32 to be isolated from mechanical stresses associated with frame 20. For example, aerodynamic forces characteristic of combustion chambers may tend to deflect the frame 20 from its originally fabricated configuration. Such deformation may result in fluctuations in the backing piece 26 to the extent that the positions of flanges 50 may shift relative to one another. Such shifting would result in axial frictional sliding of flanges 52 with respect to flanges 50 and/or axial sliding between flanges 54 and 58. Circumferentially, deflection of the frame 20 may result in sliding adjustment between the tongue and groove members, projection 38 and slot 42 of abutting panels 32. In combustors of the prior art, similar forces would be transmitted directly to thermally-stressed elements—and could result in failures.

Hence, it may be seen that by virtue of the mounting members of the present invention, the thermal stress carrying elements of the combustion chamber are effectively isolated from mechanical stresses associated with the structural load carrying members of the combustion chamber. Conversely, the structural load carrying frame 20 is isolated from the thermal stresses associated with the high temperature elements of the combustion chamber, the liner panels 32. As a result, the thermal stress bearing elements and structural stress bearing elements are substantially "decoupled" with the result being that the stress carrying frame can be formed of structurally strong material which need not have extremely high temperature capabilities, while the liner member may be formed of high temperature materials without regard for extreme structural capabilities. This permits an optimization of each characteristic without the inhibitive influence of the other.

In order to enhance the "decoupling" described, the present invention provides means for assuring that frame 20 is protected from the heat of combustion in zone 15. To this end, it is to be noted that frame shoulders 46 and flanges 50 are located behind substantial portions of panels 32. Furthermore, each panel carries an axial projection at its trailing edge which overlies the leading edge of each axially adjacent panel. Thus, the junctions of flanges 54 and 58 are shielded by projections 59 so that the frame is doubly protected.

According to another primary object of the present invention, the mounting of the individual panels 32 with respect to frame 20 is designed to achieve ease of maintainability. For this reason, the axial mounting means and the circumferential mounting means described above are each designed to be releasable. More particularly, the fabrication of a combustor liner according to the present invention would make use of the overlying-underlying relationship between flanges 50 of frame 20 and flanges 52 associated with the leading edges of panels 32. Fabrication of the combustion chamber involves the stacking of axially adjacent rows of panels beginning with rearmost (to the right in FIG. 4) and ending with the foremost (to the left in FIG. 4). Hence, the axial application of each new circumferential row of panels 32 involves the disposition of flanges 52 between frame backing piece 26 and frame flanges 50 in order to secure the leading edge of each panel; and at the same time, flanges 54 and 58 of adjacent rows of panels 32 are likewise brought into cooperation for defining the position of the trailing edges of the panels. In order to remove a defective or damaged panel, it is necessary to merely reverse this procedure by serially withdrawing panels beginning with the foremost row and continuing until the row in which the defective panel is located has been reached.

The circumferential mounting means is likewise releasable permitting removal of the panels from their respective lateral positions relative to one another. This is a further advantage of the tongue and groove cooperation between projections 38 and slots 42 carried by each panel. During the fabrication of the combustion chamber, the panels may be brought into lateral cooperation with one another and formed into circumferential rows (the rows mentioned above) by means of building up a plurality of panels circumferentially, adjacent panels cooperating with one another in tongue and groove relationship. This operation may take place prior to or concurrent with the axial mounting of the panels with respect to the frame. Upon positioning of the last panel in a circumferential row, (for an example of the lateral cooperation of panels, see FIG. 3), a substantially full circle is defined and the panels are retained therein as will be discussed hereinafter. If the rows are formed prior to axial mounting, each row is then slid into axial position with respect to frame 20 and flanges 50 of the frame as discussed hereinabove. Removal of an individual panel from a circumferential row is accomplished by reversing this process, that is, by separating adjacent panels so that those defective panels may be removed from the row. The dimensions of projections 38 and slots 42 are such that the serial lateral sliding of panels relative to adjacent panels provides sufficient clearance to remove a single panel from a particular row thereof. Alternatively, a single panel may be withdrawn from a row by sliding the panel axially with respect to the row thereby disengaging the projection 38 from its associated slot 42 at either end of the particular panel of interest.

The ease of maintainability provided by this mounting technique with respect to the releasability of the axial and circumferential mounting means will be of substantial benefit over the life of a particular gas turbine engine. Typically, life may be extended in a reasonably inexpensive fashion by the replacement of individual panels 32 which have become defective due to extended use. This is substantially less expensive than present repair techniques with unitized combustion chambers, often requiring replacement of an entire combustor liner or expensive welding and repair on a localized basis.

During operation of the combustion chamber described herein, the individual liner panel 32 would undergo a substantial buffeting from the aerodynamic stresses associated with the combustion of fuel therein. This raises the possibility of the possible migration of panels to positions other than those in which the panels are disposed upon fabrication. Were this to occur, the reliability and/or efficiency of the associated engine could be adversely effected. With the axial mounting means described hereinbefore, axial migration is substantially prevented. In order to prevent circumferential migration, the present invention provides, in one embodiment, a plurality of pins or protrusions 60 shown in FIGS. 3, 4 and 5. The pins extend radially from sockets 62 defined within the frame 20, and more particularly within backing piece 26. The pins 60, when in position, are rigidly attached to backing piece 26 and prevent lateral or circumferential motion of panels 32 by means of cooperation with detents or grooves 64 in the underside flanges 52 of selected panels. This is best illustrated in FIG. 5.

The grooves 64 are generally U-shaped with the open end toward the aft most or rearmost end of flange 52. Thus, circumferential positioning of a given row of panels into axial cooperation with frame 20, requires proper circumferential aligning of detents 64 with pins 60 (which have already been positioned in the backing piece 26) and sliding of the panels axially into cooperation therewith. Thereupon, further rows of panels are added which axially fix the rows already positioned. Due to the pins 60 and their cooperation with detents 64, the panels 32 are prevented from shifting or migrating circumferentially. Thus, the pins comprise a circumferential securing means for securing the panels circumferentially with respect to the frame. It is to be noted that it is not necessary that a pin cooperate with each panel, but the pins may be spaced appropriately about the circumference of the frame, and the lateral frictional resistance of adjacent panels will provide retention for those not directly pinned.

In order to maintain the liner panels 32 in a particular radial position with respect to frame 20, as well as to define panel positions radially as the panels are assembled with respect to the frame, the present invention further provides radial securing means. The radial securing means includes a circumferentially extending retainer 66 in the form of a segmented cylindrical hoop, and a circumferentially extending damping spring which takes the form of a corrugated segmented cylindrical band 68. The retainer and damping spring are positioned during assembly between panels 32 and backing piece 26. The retainer is engaged by a plurality of radially extending ribs 70 extending from the recessed underside 44 of panels 32 for the purpose of preloading damping spring 68. The damping spring 68 is also engaged by the backing piece 26, in order to complete the preloading compression. The segments of retainer 66 and spring 68 may be of any convenient length which will underlie substantial portions of adjacent panels. Alternatively, the retainer and spring might be an undivided hoop, rather than segmented, extending completely around frame 20. However, for purposes of easy construction and assembly, they are preferably segmented.

As a result of the disposition of the retainer and compression spring between the panels and backing piece, the panels are restrained from approaching the frame and are substantially maintained at a predetermined radial distance from the frame. The large aerodynamic forces tending to drive the panels 32 against the backing piece 26 are counterbalanced by the preload and further compression of spring 68.

According to another object of the present invention, for the purpose of maximum utilization of cooling fluid applied to the combustion chamber, the present invention provides means for cooling liner panels 32 by convection and then for forming a cooling film barrier on the heated side of the panels for protecting the panels from the direct impingement of the products of combustion. More particularly, plena 72 are formed between the backing piece 26 and the recess 44 in each panel 32. The plena provide access for the cooling fluid to contact and convectively transfer heat from the unheated sides of panels 32. The plena further provide a passage for cooling fluid which extends between a plurality of apertures 74 providing inlet means opening into the plena and exit apertures 76 for directing the fluid the plena in films upon adjacent downstream panels. Hence, a single quantity of cooling fluid entering inlet apertures 66 is directed through a plenum 72 associated with each panel. During this time heat is transferred by convection from the panel to the fluid, and subsequently the fluid progresses downstream and exits the plenum through exit apertures 76 to be directed in a film upon the immediately adjacent downstream panel 32 to protect its heated side.

In order to maintain free flow of cooling fluid through the plena 72 and inlet and exit apertures 74 and 76 respectively, the inlet apertures 74 provide a curved path for the incoming fluid which passes over a depression 78 forming a dirt trap proximate the inlet. Contaminated fluid entering the inlet apertures is curved, and the inertia of larger particles carries them from the fluid and deposits them in the dirt trap. In this way blockage of the various apertures is prevented.

Figure 6:
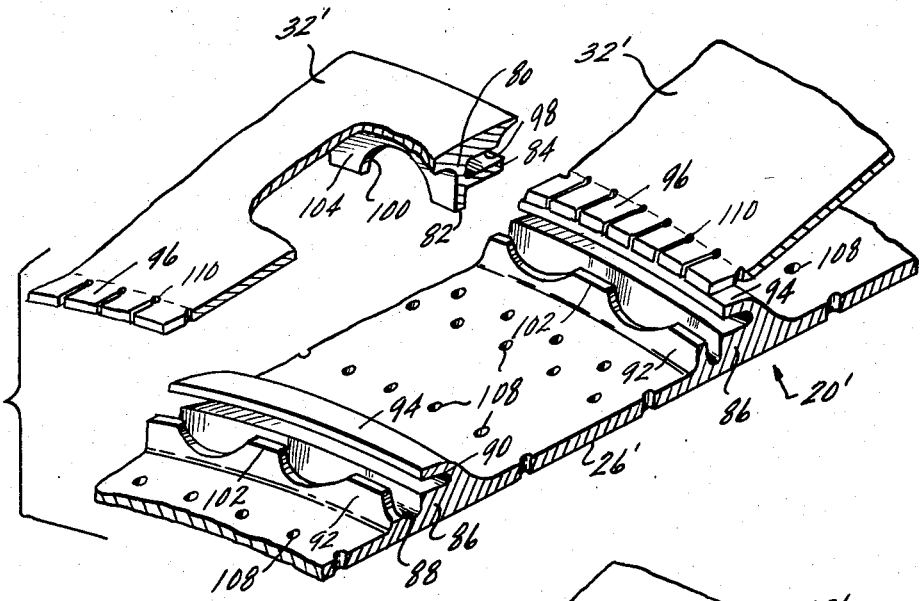
FIG. 6 is an exploded view of a combustion chamber according to a second embodiment of the present invention.
Figure 7:
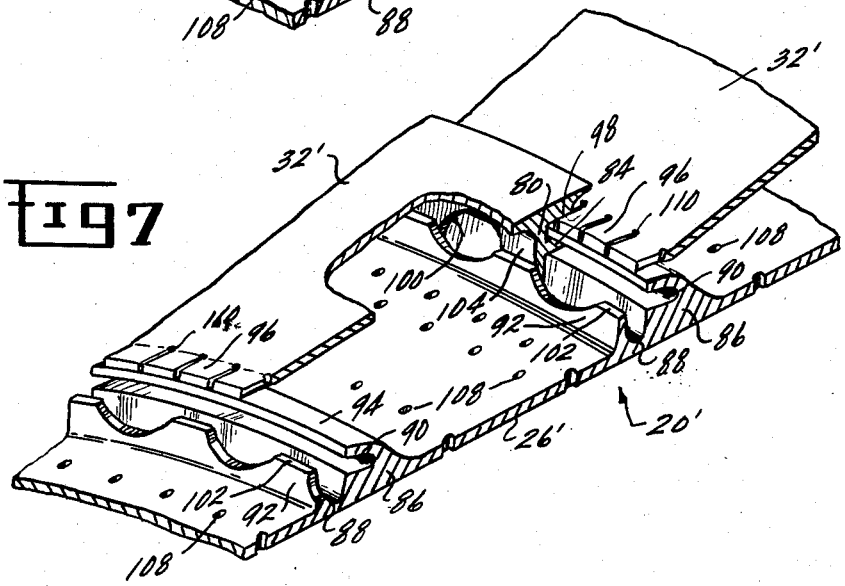
FIG. 7 is a perspective view of the elements of FIG. 6, shown in their operational relationship.
Figure 8:
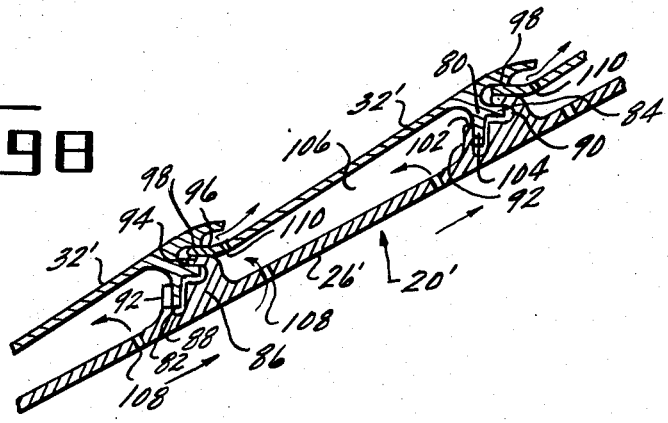
FIG. 8 is a cross-sectional view of the embodiment of FIG. 7 of a combustion chamber construction according to the present invention.

Turning now to FIGS. 6, 7 and 8, an alternative embodiment of the present invention is disclosed. In this embodiment, a plurality of combustion liner panels 32′ cooperate with one another laterally as described above with respect to the first embodiment. The panels cooperate axially with a frame 20′, including a backing piece 26′, in a manner substantially similar to that above. More particularly, each panel 32′ includes a substantially radially depending shoulder 80 on which are mounted a pair of flanges 82 and 84 substantially at right angles to one another, with flange 82 extending in the radial direction and flange 84 in the axial direction. Shoulder 80 is disposed near the trailing edge of each panel 32′.

The backing piece 26′ includes a plurality of upstanding shoulders 86 spaced axially with respect to one another and adapted to cooperate with panels 32′ as follows. Each shoulder 86 includes a pair of substantially perpendicular slots therein 88 and 90, respectively. Slot 88 is formed substantially radially and is defined between an internal portion of shoulder 86 and a substantially radial flange 92. Slot 90 extends substantially axially and is defined between an internal portion of shoulder 86 and a substantially horizontal flange 94 thereof. During cooperation therebetween, the shoulders 80 and 86 engage, and the respective flanges thereof interlock by overlying and underlying with respect to one another.

The mounting means further includes the sandwiching engagement of the leading edge 96 of each panel 32′ by a surface of axially extending flange 94 of shoulder 86 and an axially extending flange 98 disposed near the trailing edge of each panel 32′. Upon assembly, the leading edge 96 of each panel is brought into position against a flange 94 while the trailing edge of the immediately adjacent upstream panel is brought into cooperation as described above with its associated shoulder 86 of frame 20. Contemporaneously with the disposition of flanges 82 and 84 within slots 88 and 90, flange 98 is brought into overlying cooperation with leading edge 96. In this fashion the leading and trailing edges of individual panels are mounted and restrained in the axial as well as radial directions.

The manner in which a combustion liner is formed about a particular combustion zone making use of the panels of the second embodiment is similar to that described above with respect to the first embodiment. Each row of panels is brought into position and axial stack up locates the immediately adjacent upstream row. Assembly begins with the rearwardly farthest row and progresses upstream until completed.

In order to facilitate the disposition of panels in cooperation with shoulders 86 of the frame 20′, each shoulder 80 associated with panels 32′ inclues a radial gap 100 and each radial shoulder 86 carried by frame 20 includes a radial extension 102. The gap and the extension are dimensioned so that the extension may pass freely axially through the gap when the shoulders are in a first relative circumferential orientation, and the extension is restrained from axial movement through the gap when the shoulders are in a second relative circumferential orientation. In other words, panels 32′ may be slid axially into position with respect to shoulders 86 when the gaps 100 of shoulders 80 align with extensions 102 of shoulder 86. Subsequently, in order to retain the panels in position, the individual panels are indexed or rotated circumferentially by an amount sufficient to dispose the extension 102 of shoulder 86 in overlying cooperation with a similar extension 104 disposed adjacent gap 100 of shoulder 80.

In the embodiment depicted in FIGS. 6, 7 and 8, shoulders 80 and 86 are shown to include a plurality of gaps and extensions such that the opposed flanges thereof are substantially scalloped. The interposition of panels and the indexing thereof are accomplished as described hereinabove with the panels illustrated in assembled and retained position in FIG. 7.

Cooling of the liner panels of this second embodiment is similar to that described with respect to the first embodiment, with panels 32′ defining plena 106 between the panels and backing piece 26′. The frame includes a plurality of inlet apertures 108 through which cooling fluid enters the plena as well as a plurality of exit apertures 110 through which the cooling fluid is directed in a protective film barrier across the heated side of the panels. The operation of the cooling system is different from that with respect to the foregoing embodiment in that the cooling fluid which convectively cools the side of panel 32′ bounding plenum 106 is directed over the heated side of the very same panel rather than the axially adjacent panel. This proves advantageous in situations where panels are heated to different relative temperatures so that the application of cooling fluid may be defined as to quantity with respect to each individual panel. Thus, each panel can be cooled independently of the effects upon others, and this results in optimized cooling on an individual panel basis.

In operation, the combustors of the present invention operate substantially similarly to those combustors well known in the art. As described hereinbefore, pressurized air mixed with fuel is burned (in FIG. 1) within combustion chamber 11 in the combustion zone 15 of FIG. 2 and expelled to the right thereof to drive the turbine 18 and provide a thrust toward the left. The particular advantages of the present invention reside in the ease of fabrication of the combustion chamber as well as in its increased reliability and maintainability. Worn or damaged liner panels 32 or 32′ may easily be replaced by reversing the assembly procedures outlined above and withdrawing panels axially beginning with the upstream end of the combustion chamber and progressing downstream to the point of wear.

Additionally, during operation, the thermal stresses and structural mechanical stresses associated with the combustion chamber may be borne by independent means (the liner and the structural frame) which, by virtue of the present invention, may be designed to make best use of the thermal and mechanical strengths respectively thereof without penalties associated with the combined effects of both thermal and mechanical stresses. This characteristic will result in combustion chambers of extremely enhanced reliability and life by the utilization of the present invention.

As a further benefit of the present invention, the cooling fluid applied to the combustion chamber serves the double functions of cooling by convection of the plenum defining sides of the individual pnels and subsequently of forming a cooling film boundary layer on the heated sides of the combustor liner panels. This double duty ensures that the cooling fluid is used to its maximum efficiency, resulting in improved overall engine efficiency.

This specification concludes with a number of claims to the present invention. However, it is apparent that those skilled in the art might make structural variations of the embodiments disclosed herein or equivalents thereof without departing from the spirit of the invention. For example, frictionally slideable mounting arrangements equivalent in function to the tongue and groove configuration disclosed herein may be substituted therefor without departing from the spirit of the present invention. Furthermore, other mounting systems having the removability features of the present invention would be equivalent thereto. Such variations, as well as other equivalents, are intended to be covered within the scope of the appended claims.

What is claimed as new and desired to be secured by Letters Patent of the United States is:

1. A combustion chamber for use in gas turbine engines, the chamber comprising:

an inlet for receiving air and fuel to be burned;

an outlet for expelling products of combustion;

high strength structural frame means disposed between the inlet and the outlet for supporting mechanical forces associated with the chamber;

liner means cooperating with the frame and defining a combustion zone, said liner means including a plurality of panels of high temperature materials;

circumferential mounting means for positioning said panels laterally with respect to one another;

axial mounting means for positioning said panels axially with respect to said frame means;

wherein said circumferential mounting means includes frictionally slideable engaging means cooperating with adjacent pairs of said panels;

wherein said frictionally slideable engaging means includes a projection disposed on one lateral edge of preselected first of said panels, and a mating slot disposed on an opposed edge of preselected second of said panels disposed adjacent said first panels;

wherein said axial mounting means includes;

first radially extending shoulder means cooperating with preselected of said panels, second radially extending shoulder means cooperating with said frame means, and engaging said first shoulder means, and a first axially extending flange carried by said first shoulder means; and a second axially extending flange carried by said second shoulder means, said second flange underlying and interlocking with said first flange.

2. The combustion chamber of claim 1 wherein said axial mounting means further includes:

a third flange cooperating with preselected first of said panels; and a fourth flange cooperating with preselected second of said panels, said third and fourth flanges engaging and cooperating with one another.

3. The combustion chamber of claim 1 further including:

circumferential securing means for securing said panels circumferentially with respect to said frame means.

4. The combustion chamber of claim 3 wherein said circumferential securing means includes a plurality of radially extending protrusions cooperating with preselected of said panels and said frame means.

5. The combustion chamber of claim 1 wherein individuals of said panels and portions of said frame combine to define a plurality of plena, and wherein said combustion chamber includes inlet apertures opening into said plena for directing a cooling fluid thereto, and said combustion chamber further includes exit apertures for directing cooling fluid from said plena in a film upon said panels.

6. The combustion chamber of claim 1 wherein said first shoulder means includes a radial gap, and said second shoulder means includes a radial extension, said gap and said extension being dimensioned so that the extension may pass freely axially through the gap when the shoulders are in a first relative circumferential orientation, and said extension is restrained from axial movement through the gap when the shoulders are in a second relative circumferential orientation.

7. The combustion chamber of claim 6 wherein:

said frame and preselected of said panels define a plurality of plena;

said frame includes inlet apertures opening into said plena for directing a cooling fluid thereto; and said panels include exit apertures for directing cooling fluid from said plena in a film upon predetermined of said panels.

8. The combustion chamber of claim 6 wherein:

said exit apertures are disposed so as to direct said film upon the same panel in which the aperture is disposed.

9. The combustion chamber of claim 1 wherein said projection and said slot are dimensioned so as to provide a slideable, frictional tongue and groove cooperation.

10. A combustion chamber for use in gas turbine engines, the chamber comprising:

an inlet for receiving air and fuel to be burned;

an outlet for expelling products of combustion;

high strength structural frame means disposed between the inlet and the outlet for supporting mechanical forces associated with the chamber;

liner means cooperating with the frame and defining a combustion zone, said liner means including a plurality of panels of high temperature material;

circumferential mounting means for positioning said panels laterally with respect to one another;

axial mounting means for positioning said panels axially with respect to said frame means;

and further including:

radial securing means for securing said panels radially with respect to said frame means, said radial securing means including a circumferentially extending damping spring disposed between and engaging said panels and said frame, whereby said panels are restrained from approaching said frame, and are maintained at a predetermined radial distance from said frame.

11. The combustion chamber of claim 10 wherein said radial securing means further includes a circumferentially extending retainer in the form of a segmented cylindrical hoop, and wherein said damping spring comprises a corrugated, segmented generally cylindrical band.

12. The combustion chamber of clam 11 wherein said retainer and said damping spring are positioned between said frame and individuals of said panels.

* * * * *